US005783936A

United States Patent [19]

Girard et al.

[11] Patent Number: 5,783,936

[45] Date of Patent: Jul. 21, 1998

[54] TEMPERATURE COMPENSATED REFERENCE CURRENT GENERATOR

[75] Inventors: Phillipe Girard, Corbiel Essones; Patrick Mone, Ponthierry, both of France

[73] Assignee: International Business Machines Corporation, Armonk, N.Y.

[21] Appl. No.: 758,325

[22] Filed: Dec. 3, 1996

[30] Foreign Application Priority Data

Jun. 12, 1995 [EP] European Pat. Off. ..... 95480170

[51] Int. Cl.[6] ..... G05F 3/20

[52] U.S. Cl. ..... 323/315; 323/907

[58] Field of Search ..... 323/313, 314, 323/315, 316, 907; 327/530, 534, 535, 538, 539

[56] References Cited

U.S. PATENT DOCUMENTS

| | | | |
|---|---|---|---|
| 4,769,589 | 9/1988 | Rosenthal | 323/313 |
| 4,970,415 | 11/1990 | Fitzpatrick et al. | 307/448 |
| 5,013,934 | 5/1991 | Hobrecht et al. | 327/527 |
| 5,113,129 | 5/1992 | Hughes | 323/316 |
| 5,148,099 | 9/1992 | Ong | 323/314 |
| 5,220,273 | 6/1993 | Mao | 323/907 |
| 5,570,008 | 10/1996 | Goetz | 323/315 |

FOREIGN PATENT DOCUMENTS

| | | | |
|---|---|---|---|
| 0504983 | 3/1992 | European Pat. Off. | G05F 3/24 |
| 4034371 | 10/1991 | Germany | G05F 3/24 |

OTHER PUBLICATIONS

Proceedings of the Midwest Symposium on Circuits & Systems, Monterey, May 14–17, 1991, vol. 2, May 14, 1991, pp. 843–846, Adams et al "OTA Extended Adjustment Range and Linearization via Programmable Current Mirrors".

Proceedings of the Midwest Symposium on Circuits & Systems, Monterey, May 14–17, 1991, vol. 1, May 14, 1991, pp. 340–343, Dillman N: "A Self–Configuring Accelerometer Hybrid".

*Primary Examiner*—Matthew V. Nguyen

*Attorney, Agent, or Firm*—Steven B. Phillips; John B. Frisone

[57] ABSTRACT

A temperature compensated resistance current generator. The generator provides temperature compensated reference current in a digital CMOS environment where resistors with positive temperature coefficients are not available, and where temperature coefficients are large. The current generator has two current sources and a subtraction circuit which subtracts the current from one current source from the current from the other current source to create a primary current. A proportionality circuit multiplies the primary current by a constant to produce the generator output.

6 Claims, 1 Drawing Sheet

TEMPERATURE COMPENSATED REFERENCE CURRENT GENERATOR

BACKGROUND OF THE INVENTION

1. Field of Invention

The present invention generally relates to current reference generation circuits and more particularly to a reference current generator that is compensated in temperature when resistors with high negative temperature coefficients (such as those that can be found in digital CMOS technology) are used.

2. Prior Art

Many integrated circuits require a reference current generator to supply the DC bias current for their operation. When designing such a current generator, it is very important to have a good control on the tolerance of this DC bias current, referred to hereinafter as the reference current Iref, to ensure a good control of the circuit characteristics, such as the power supply consumption which is an essential parameter in today's applications. To that end, the current technology trend is to render the reference current Iref independent of the power supply, temperature variations and in some extent of the process parameters. The independence from the temperature variations is of particular importance. There are well known techniques that allow obtaining a more or less good control of the reference current Iref when the technology offers a large menu of well adapted devices. Unfortunately, such a large menu can be found only in analog CMOS technology, making good control of the reference current more difficult in digital CMOS technology.

In analog CMOS technology, the traditional way to implement a temperature compensated reference current generator is to generate a primary current I which results from the addition of two currents I1 and I2 that are generated by two different current sources. These current sources are built using resistors which have inherently a temperature coefficient of resistance, usually referred to as the TCR. Currents I1 and I2 also have an inherent temperature coefficient, labelled TC1 and TC2 respectively. For the primary current I being equal to the sum I1 +I2, the parameter dI/dT which measures the temperature dependence of the primary current I, i.e. its temperature coefficient TC, can be written as:

$$dI/dT=dI1/dT+dI2/dT=I1*TC1+I2*TC2 \quad (1)$$

(where T is absolute temperature in degrees Kelvin).

If the current sources are designed to have temperature coefficients of opposite polarity, equation (1) now becomes (assuming TC2 is negative):

$$dI/dT=(|I1*TC1|)-(|I2*TC2|) \quad (2)$$

it is therefore possible from equation (2) to have parameter dI/dT be made equal to zero.

FIG. 1 shows a conventional reference current generator 10 biased between first and second supply voltages, referred to hereinbelow as Vdd and the ground Gnd, based upon this principle. The I1 current source is usually of the dVbe type to supply a current I1 whose temperature coefficient TC1 is positive. dVbe is the difference in voltage across diodes D1 and D2. Conversely, the I2 current source is usually of the Vbe type whose temperature coefficient TC2 is negative. Vbe is the voltage across diode D3.

Now turning to FIG. 1, the I1 and I2 current sources, referenced 11 and 12 respectively are physically implemented in a classical way. Current source 11 is first comprised of PFET device T1, diode-connected NFET device T2 and a first diode D1 all connected in series between Vdd and the ground Gnd. Current source 11 is further comprised of diode-connected PFET device T3, NFET device T4, resistor R1 and a second diode D2 that are similarly connected in series between Vdd and the ground Gnd. The gate of NFET device T2 is connected to the gate of NFET T4. A PFET device T5 has its source tied to Vdd and its gate connected to the gates of PFET devices T1 and T3. The role of PFET device T5 is to mirror current I1 flowing through resistor R1 as standard.

With this type of current source, the current I1 that is outputted from the drain of PFET device T5 is given by equation:

$$I1=(k*T/q*R1)*\text{Log } m \quad (3)$$

wherein k is Boltzmann's constant, q is electronic charge, T is absolute temperature in degrees Kelvin and m is the ratio of the voltages across diodes D1 and D2.

Current source 12 is first comprised of PFET device T6, diode-connected NFET device T7 and diode D3 that are connected in series between Vdd and the ground Gnd as illustrated. It is further comprised of diode-connected PFET device T8, NFET device T9 and resistor R2 that are still connected in series between Vdd and the ground Gnd. The gate of NFET device T7 is connected to the gate of NFET device T9. A PFET device T10 has its source tied to Vdd and its gate connected to the gates of PFET devices T6 and T8. The role of PFET device T10 is to mirror current I2 flowing through resistor R2 as standard.

With this type of current source, the current I2 that is outputted from the drain of PFET device T10 is given by equation:

$$I2=Vbe/R2 \quad (4)$$

wherein Vbe is the forward bias of diode D3.

Currents I1 and I2 flowing through respective mirroring PFET devices T5 and T10 respectively are summed at node 13 to generate the primary current I. This primary current I is applied to the gate of diode-connected NFET device T11 to generate a reference voltage Vref that is used to bias the gate of (at least one) NFET output device T12 whose source is tied to the Gnd potential. The reference current Iref is available at the drain of NFET device T12 at output node 14. The reference current Iref is derived from the primary current I by a proportionality factor n. In other words, Iref=n*I=n*(I1+I2), wherein n is determined by the respective size ratio of NFET devices T11 and T12 as known by those skilled in the art. When implemented in the way illustrated in FIG. 1, the parameter dI/dT which measures the temperature dependence of the primary current I given in equation (1) is given by:

$$dI/dT=I1*(1/T-TCR1)+I2*((dvbe/dT)*(1/Vbe)-TCR2) \quad (5)$$

In equation (5), the first term can be made either positive or negative (depending on the value of TCR1) in an analog CMOS technology while the second term is always negative because of the particular technique employed to build the I2 current source 12 (dvbe/dT is negative). As a result, the compensation is possible. Since at the ambient temperature, T equals about 300 iK, to have the first member of equation (5) positive, it suffices to select a value for TCR1 (the standard unit for the TCR is given in %/° C.) that is less than a critical value equal to 0.33%/° C. (or 0.0033/° C.) and to adapt appropriately the other parameters of equation (5) to obtain the desired compensation, which may be either total or partial, depending upon the circuit specifications. In a conventional bipolar or analog CMOS technology offering implanted resistors with medium resistibilities (400 to 2000 Ω/sq), there is no problem obtaining TCR1 value in the range of 0.001 to 0.002/°C. which can bring the desired temperature compensation. Unfortunately, this is not the case for a pure digital CMOS technology for which all TCRs are greater than 0.0033/°C., typically about 0.005/°C., so that no temperature compensation can be expected. As a matter of fact, because digital CMOS technologies are increasingly used to build analog circuits, there is a considerable demand to date for manufacturing analog integrated circuits in digital CMOS technologies.

OBJECTS OF THE INVENTION

Therefore, it is a primary object of the present invention to provide a temperature compensated reference current generator that generates a reference current whose temperature coefficient can be made equal to zero even when resistors with high temperature coefficients (such as those that can be found in digital CMOS technology) are used.

It is another object of the present invention to provide a temperature compensated reference current generator that is based on the subtraction of two currents generated by current sources whose temperature coefficients have the same polarity.

It is another object of the present invention to provide a temperature compensated reference current generator that is based on the subtraction of two currents generated by current sources whose temperature coefficients are negative.

SUMMARY OF THE INVENTION

The present invention relates to a temperature compensated reference current generator integrated in a semiconductor chip according to a digital CMOS technology, i.e., offering only resistors with a high temperature coefficient (TCR). The current generator is comprised of: a first current source including at least one of such resistors for generating a first current (I1) having a first negative temperature coefficient (TC1); a second current source including at least one of such resistors for generating a second current (I2) having a second negative temperature coefficient (TC2); and finally, a subtraction circuit for generating a primary current (I) equal to their difference (i.e. I=I1−I2) such that its temperature coefficient TC= dI/dT can be made equal to zero for total temperature compensation. The reference current (Iref) outputted by the current generator is simply derived from said primary current by a factor of proportionality (i.e. Iref=n*I).

In a preferred embodiment, said subtraction circuit consists of a mirroring circuit that inverts the second current and a summation node that sinks the current at a node where the first current is applied.

The novel features believed to be characteristic of this invention are set forth in the appended claims. The invention itself, however, as well as other objects and advantages thereof, may be best understood by reference to the following detailed description of an illustrated preferred embodiment to be read in conjunction with the accompanying drawings.

DETAILED DESCRIPTION OF THE PREFERRED EMBODIMENTS

Figure 1:
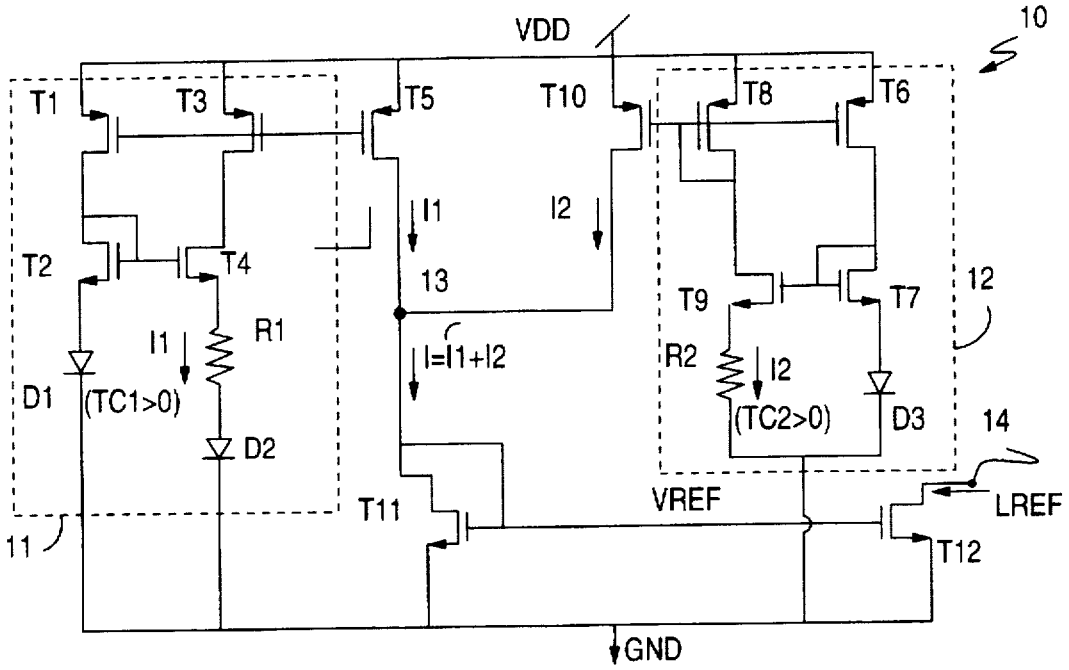
FIG. 1 PRIOR ART
FIG. 1 shows a conventional circuit implementation of a reference current generator implemented in a conventional analog CMOS technology wherein two currents having temperature coefficients of opposite polarity are summed to generate a temperature compensated primary current from which the reference current Iref is derived.

To fit with digital CMOS technologies where resistors have necessarily a high negative TCR, there is disclosed hereunder an innovative approach of the design of a temperature compensated reference current generator, significantly departing from the principle of the conventional generator illustrated in FIG. 1. As a matter of fact, it is adapted to operate with current sources which generate currents whose temperature coefficient is always negative. In essence, according to this new approach, the currents I1 and I2 generated by their respective current sources are subtracted to generate the primary current I, instead of adding them, i.e. I=I1−I2, and the parameter dI/dT=TC which measures its temperature dependence now becomes:

$$dI/dT=dI1/dT-dI2/dT=(|I2*TC2|)-(|I1*TC1|) \quad (6)$$

It is therefore possible to obtain a reference current Iref derived from the primary current I that has a null temperature coefficient. The novel temperature compensated reference current generator that performs this difference bears numeral 15 in FIG. 2. With regard to current generator 10 of FIG. 1, same elements bear same references. It is to be noted that the current sources 11 and 12 have the same construction. But, now the temperature coefficient TC1 of the I1 current is negative (as already is TC2), a restriction imposed when the current source is built on a digital CMOS circuit.

Figure 2:
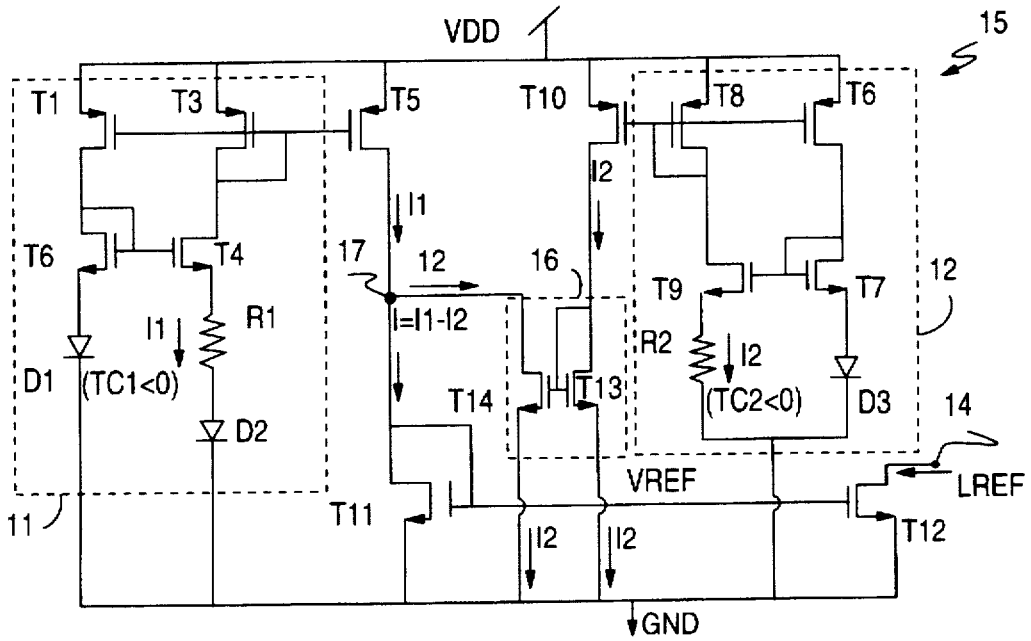
FIG. 2 shows the circuit implementation of the reference current generator of the present invention adapted for being implemented in digital CMOS technology wherein two currents having negative temperature coefficients are subtracted to generate a temperature compensated primary current from which the reference current Iref is derived.

Now turning to FIG. 2, the subtraction will be performed by mirroring circuit 16 and dotting node 17. Mirroring circuit 16 is comprised of two NFET devices T13 and T14. As apparent from FIG. 2, current I2 flowing through PFET T10 is mirrored by diode-connected NFET device T13 and NFET device T14 as a sink current at node 17. The sources of NFET devices T13 and T14 are tied to the ground Gnd. The common gate/drain of NFET device T13 is connected to the gate of NFET device T14. The drain of the latter is connected to node 17 formed by the drains of PFET device T5 and NFET device T11 that are shorted. As a final result of the construction depicted in FIG. 2, source current I2 is subtracted from source current I1 at this node 17 before being applied to the drain of NFET device T11. Hence, the primary current flowing through T11 is I1−I2. Parameter dI/dT=TC can be made equal to zero (or to any positive or negative value if so desired) by an adequate selection of I1, I2, TC1 and TC2 values according to equation (6). In practice, this is zeroed by a proper choice of second current I2 and thus of resistor R2. Finally, the reference current Iref such as Iref=n*I=n*(I1−I2) is made available at the drain of NFET device T12 at node 14 with a temperature coefficient that can be minimized or made equal to zero. Parameter n is a factor of proportionality that depends on the respective sizes of NFET devices T11 and T12 as mentioned above.

An actual circuit has been implemented in a 0.5 um digital CMOS technology whose lowest TCR value is 0.0045/°C. (thus greater than the above mentioned critical value of 0.0033/°C.). The current generator 15 has been designed to get a zero temperature coefficient for a primary current I of about 100 uA. The table hereinbelow gives the values of the temperature coefficient TC (in ppm/°C.) of primary current I for different values of the temperature (in degrees Celsius) and for three values of resistor R2.

TABLE

| Temperature (°C.) | R2 = 32 kΩ | R2 = 34 kΩ | R2 = 36 kΩ |
|---|---|---|---|
| 0 | 104.9 | 106.275 | 107.5 |
| 25 | 105.0 | 106.166 | 107.2 |
| 50 | 105.2 | 106.124 | 107.0 |
| 75 | 105.4 | 106.132 | 106.8 |
| 100 | 105.5 | 106.180 | 106.7 |
| 125 | 105.7 | 106.259 | 106.7 |
| TC = dI/dT | +61 | +11 | −60 |

One can see that R2=34 kΩ represents an adequate value for the reference current generator 15 of the present invention, because for that value the temperature coefficient TC of I is very small. In practice, any temperature coefficient value such that −10 ppm/°C.<TC<10 ppm/°C. would be adequate. Theoretically, a resistor value of 34.3 kΩ would exactly lead to total temperature compensation (i.e. TC=0), and thus to a reference current Iref whose temperature coefficient would be also null.

Therefore, there is described above a temperature compensated reference current generator which enables to generate a totally temperature compensated reference current Iref even when the technology offers only high TCR resistors such as those produced by state of the art digital CMOS processes. However, the principle at the base of the present invention can also be implemented in analog CMOS technologies. This will help to stabilize the circuit performance versus the temperature variations (which nowadays are extended both in the lower and upper ranges) and will give a better control of the power consumption which is really a critical parameter (e.g. in battery back-up circuits). The reference current generator of the present invention can also generate reference currents with either positive or negative temperature coefficients whenever required. This can help to compensate the variations of the performance of any analog circuit versus temperature. For instance, the decrease of VCO center frequency with temperature could be compensated with a positive temperature coefficient reference current.

Finally, the reference current generator 15 described by reference to FIG. 2, is a basic circuit implementation of the disclosed inventive concept, but it may be understood that many other circuits can be built around it or derived therefrom.

We claim:

1. A temperature compensated reference current generator comprising:

a first current source having a negative temperature coefficient for generating a first current;

a second current source having a negative temperature coefficient for generating a second current, the second current source being disposed in parallel with the first current source between power and ground terminals;

a subtraction circuit connected to the first and second current sources for generating a primary current having a temperature coefficient, the primary current being generated by subtracting one of the first and second currents from the other; and, a proportionality circuit disposed between the subtraction circuit and the ground terminal, the proportionality circuit providing a reference current which is equal to the primary current multiplied by a proportionality constant.

2. The current generator of claim 1 wherein the substraction circuit includes:

a mirroring circuit that inverts the second current; and a summation node that adds the first current to an inverted second current to generate the primary current.

3. The current generator of claim 1 wherein the temperature coefficient of the primary current is zero.

4. The current generator of claim 2 wherein the temperature coefficient of the primary current is zero.

5. The current generator according to any of claims 1–2 wherein the temperature coefficient of the primary current is positive.

6. The current generator according to any of claims 1–2 wherein the temperature coefficient of the primary current is negative.

* * * * *